United States Patent [19]

Coone

[11] Patent Number: 4,544,165

[45] Date of Patent: Oct. 1, 1985

[54] INFLATABLE PACKER

[75] Inventor: Malcolm G. Coone, Houston, Tex.

[73] Assignee: Xenpax, Inc., Houston, Tex.

[21] Appl. No.: 494,962

[22] Filed: May 16, 1983

[51] Int. Cl.[4] ..... E21B 33/127

[52] U.S. Cl. ..... 277/34; 277/9

[58] Field of Search ..... 277/34, 34.3, 34.6, 277/9

[56] References Cited

U.S. PATENT DOCUMENTS

| | | | |
|---|---|---|---|
| 2,778,432 | 1/1957 | Allen | 277/34 |
| 3,542,127 | 11/1970 | Malone | 277/34 |
| 3,604,732 | 9/1971 | Malone | 277/34 |
| 3,837,947 | 9/1974 | Malone | 277/34 |
| 4,299,397 | 11/1981 | Baker et al. | 277/34 |

*Primary Examiner*—Robert I. Smith

[57] ABSTRACT

An inflatable packer is disclosed that includes inner and outer sleeves of elastomeric material. An annular sheath of overlapping reinforcing members is located between the sleeves. Each reinforcing member is bent adjacent each end to move a section adjacent each end into a plane that is parallel to and spaced from the center section of the reinforcing member. The members are bent at an angle that allows the members to overlap with their ends in alignment. The reinforcing members are mechanically clamped between inner and outer anchor members that form the packer heads.

17 Claims, 7 Drawing Figures

FIG.1
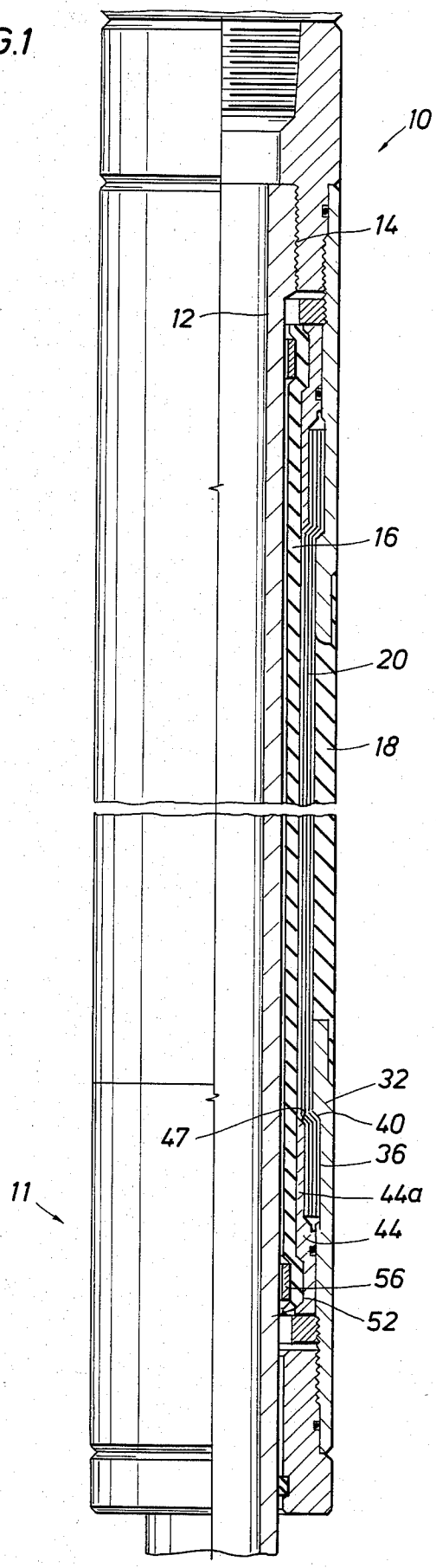
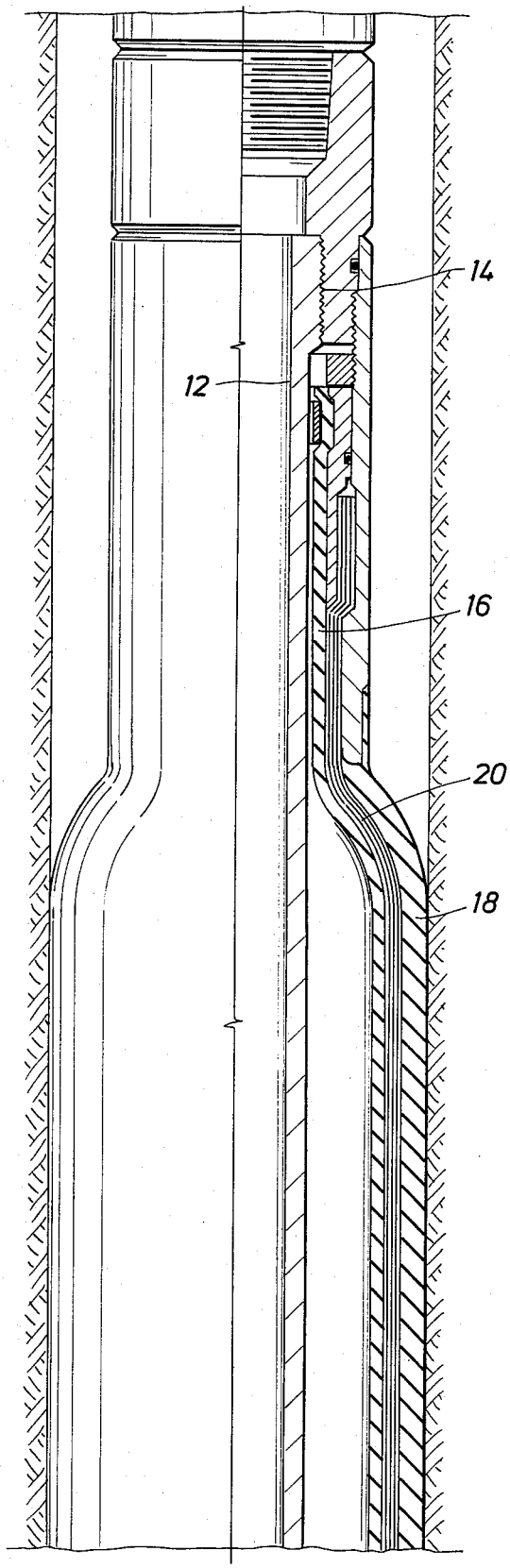
FIG. 2

FIG. 4
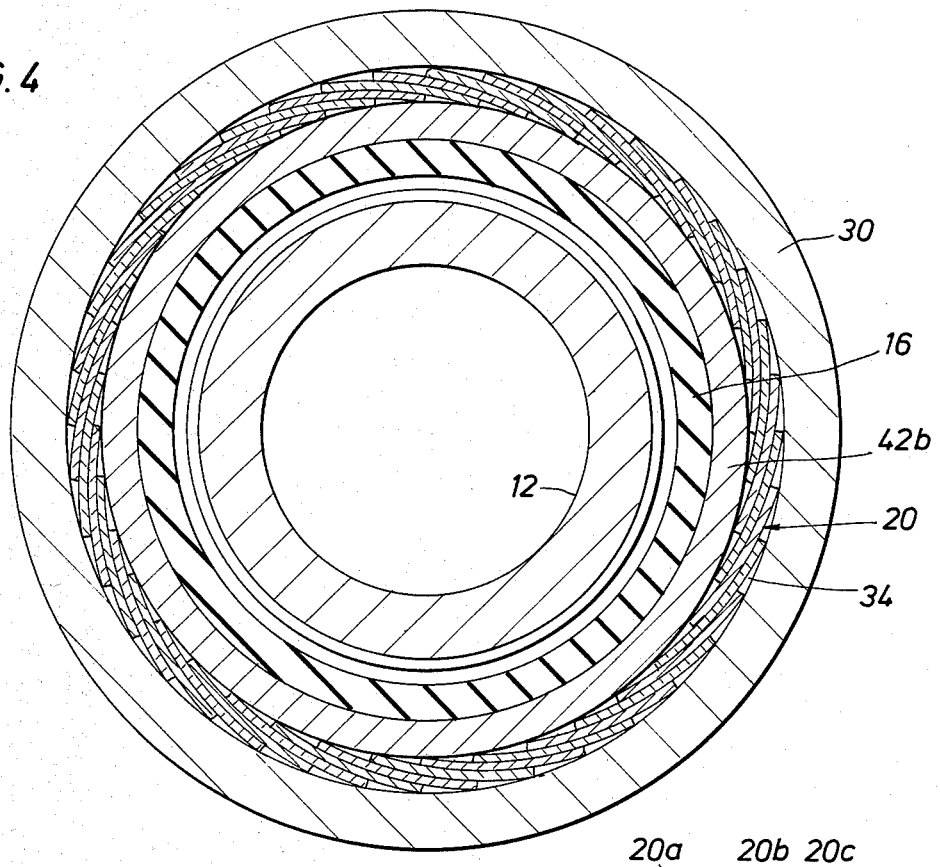
FIG. 7
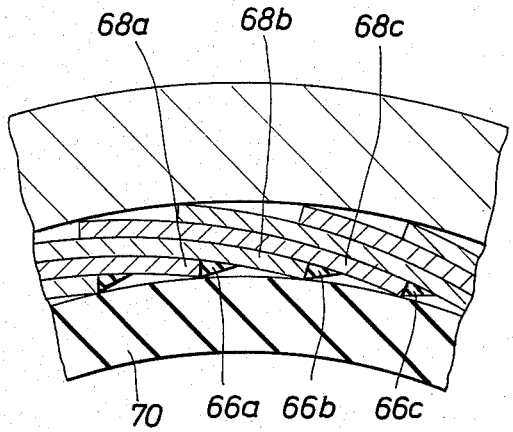
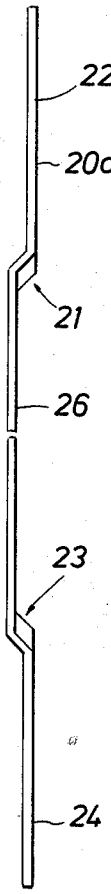
FIG. 5
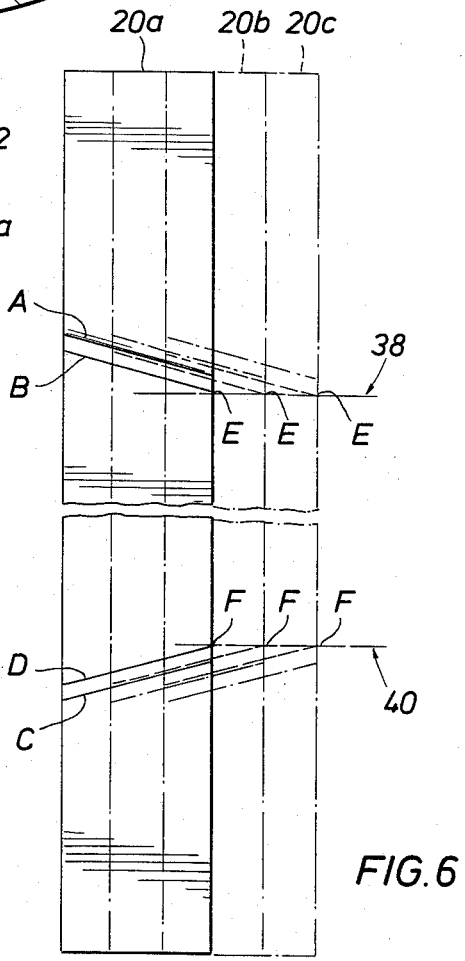
FIG. 6

INFLATABLE PACKER

This invention relates to inflatable packers generally, and in particular to inflatable packers that employ a sheath of individual overlapping strips of metal as reinforcing for the packer.

Inflatable packers generally include two annular packer heads mounted on a mandrel with at least one of the packer heads being free to move toward the other one as the packer is inflated. The packer consists of an inner sleeve of resilient material and an outer sleeve of elastomeric material. The reinforcing required to support the outer sleeve when the packer is set and subjected to a differential pressure is located between the sleeves. The sleeves and the reinforcing are attached to the packer heads in some manner.

Various ways have been used to attach the ends of individual reinforcing members to the packer heads. For example, see U.S. Pat. No. 3,837,947 entitled "Method of Forming an Inflatable Member", which issued Sept. 24, 1974. This patent uses an adhesive mixture to bond the reinforcing members to the packer heads. Usually, however, the ends of each member is welded to the packer heads. In either case, great care must be exercised to see that the reinforcing members are positioned uniformly in the desired overlapping position, and is, therefore, time consuming and expensive.

In addition, with inflatable packers that are used in operations requiring the temporary sealing of the annulus of a well bore, such as drill stem testing operations, when the outer or inner sheath has failed or appears to be on the verge of failing, the packers are sent back to the shop for salvage. Usually, the reinforcing members are not reused, but the packer heads are. Where the reinforcing members are welded or otherwise bonded to the packer heads as was previously done, this makes the disassembly of the packer heads and the reinforcing members very expensive and even impractical in some cases.

Therefore, it is an object of this invention to provide an inflatable packer having a plurality of elongated members of resilient material arranged in side-by-side overlapping position to form a sheath to reinforce the sleeves of elastomeric material of the packer in which the ends of the reinforcing members are anchored to the packer heads by a mechanical lock arrangement that does not require the individual reinforcing members to be welded or otherwise bonded to the packer heads. As a result the packer heads and the reinforcing members can be quickly and easily disassembled by releasing the mechanical lock.

It is a further object of this invention to provide an inflatable packer in which each individual reinforcing member has a bend adjacent its ends along lines that make an angle with the longitudinal axis of the reinforcing member to allow the reinforcing members to overlap with their ends in alignment and to be held against movement relative to the packer heads by clamping the packer heads to the bend in the members.

It is another feature and object of this invention to provide reinforcing members that are self spacing in that they will move to a uniform spacing under the clamping force of the retaining sleeve.

It is a further object and feature of this invention to provide an inflatable packer having a plurality of individual reinforcing members of resilient material in overlapping position to form a reinforcing sheath with each reinforcing member having a strip of elastomeric material that is bonded to the inner edge of the member to engage the adjacent overlapping reinforcing member and prevent the inner sleeve from being extruded into the space between the reinforcing members when the inner sleeve is subjected to the pressure required to cause the members to bend outwardly and set the packer.

These and other objects, advantages, and features of this invention will be apparent to those skilled in the art from a consideration of this specification, including the attached drawings and appended claims.

In the drawings:

FIG. 1 is a view partly in elevation and partly in section of an inflatable packer with the ends of the reinforcing members of the packer anchored to the packer head in accordance with the preferred embodiment of this invention;

FIG. 2 is a view similar to FIG. 1 showing the packer inflated sealing the annulus between a pipe string and a well bore;

FIG. 4 is a sectional view taken along line 4—4 of FIG. 3;

FIG. 5 is a side view of a reinforcing member constructed in accordance with this invention;

FIG. 6 is a plan view of the reinforcing member of FIG. 5 showing its relationship with adjacent reinforcing members when they are arranged in overlapping position; and FIG. 7 is a sectional view of the inner and outer sleeves of an inflatable packer material with an alternate embodiment of reinforcing members located between the sleeves.

Figure 3:
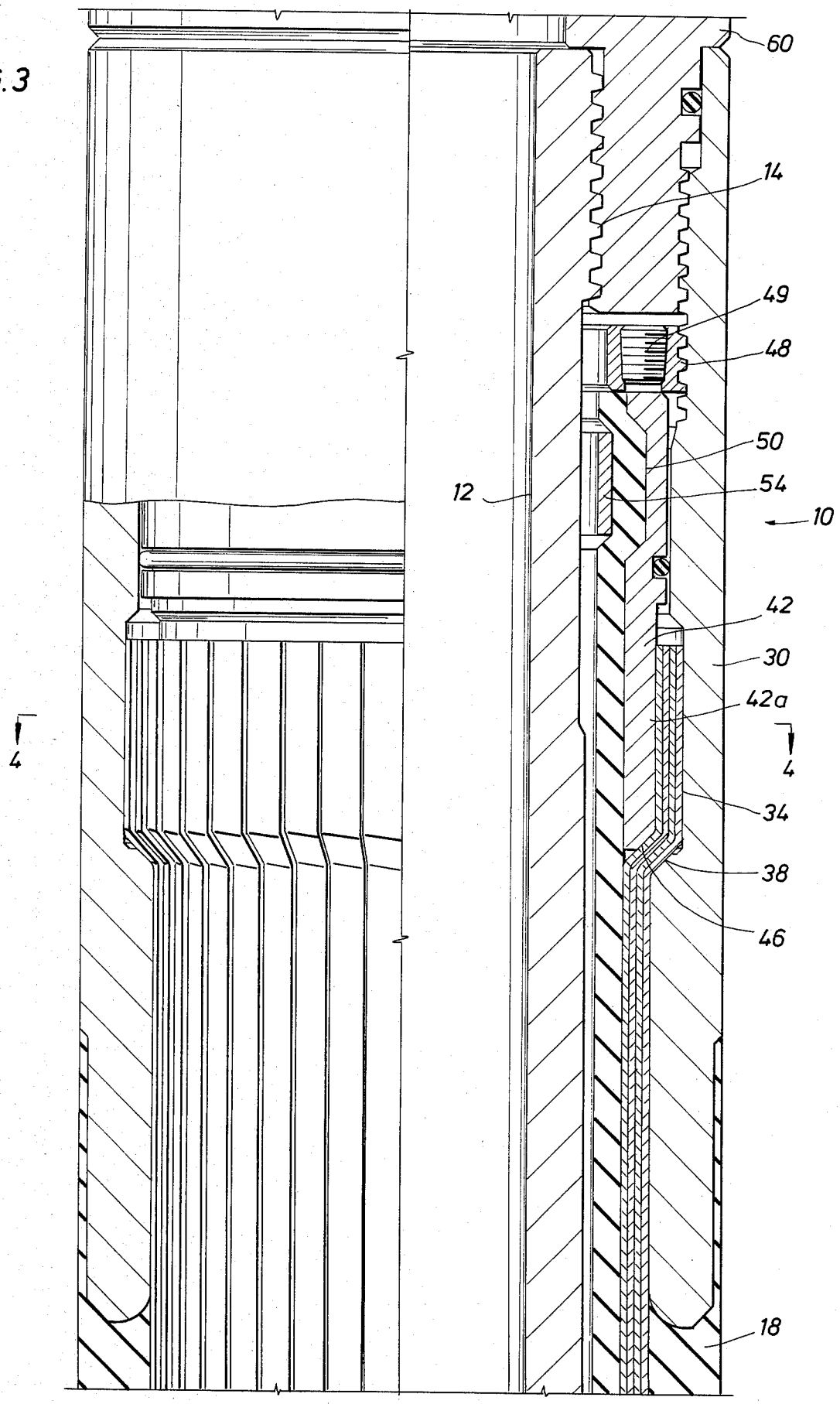
FIG. 3 is a view partially in section and partially in elevation of the upper end of the packer of FIG. 1 on an enlarged scale.

The packer includes upper annular packer head 10 and lower annular packer head 11. Each packer head is an assembly of several pieces. The packer includes tubular mandrel 12, which is connected to upper packer head 10 by threads 14. The mandrel is not connected to lower packer head 11 but extends through it. In this way, the lower head can move upwardly toward the upper head when the packer is inflated, as shown in FIG. 2. The lower end of mandrel 12 is connected to and supports whatever pipe or equipment is located below the packer in the conventional manner.

The packer also includes inner sleeve 16 of elastomeric material and outer sleeve 18 also of elastomeric material. Located between the inner and outer sleeves of elastomeric material is a sheath of reinforcing members, indicated generally by the number 20. The ends of the two sleeves and the reinforcing members are all bonded, attached, or otherwise connected to packer heads 10 and 11. The manner in which the reinforcing members are attached will be described first.

In accordance with this invention, each reinforcing member, such as member 20*a* in FIG. 5, has a bend in it adjacent each end that in effect, moves end portions 22 and 24 of the reinforcing member into a plane that is parallel to but spaced from the plane of center section 26. Each bend is made along two parallel bend lines that are not perpendicular to the longitudinal axis of the reinforcing member. For example, bend 21 occurs along bend lines A and B, as shown in FIG. 6, and bend 23 is made along lines C and D. In the embodiment shown, the two sections of the member between the bend lines, i.e. the bent sections, make approximately a 45° angle with end sections 22 and 24 and center section 26. By having bend lines A, B, C, and D, at an acute angle to the longitudinal axis of the member, the members can be overlapped as shown in FIG. 6, while maintaining their ends in alignment. The angle of the bend is selected for the particular overlap desired and is also a function of the width and thickness of the member.

The structure for clamping the upper and lower packer heads to the end of the reinforcing members is the same so the method of assembly of only the upper packer head with the reinforcing members will be described in detail.

To assemble the upper packer head and the reinforcing members, as shown in FIGS. 3 and 4, the reinforcing members are arranged in a circle and loosely held by an O-ring or the like in overlapping position on a tubular support member of approximately the desired inside diameter of the sheath of reinforcing members. The ends of the reinforcing members are not supported by the mandrel so the ends of the members can be moved inwardly to allow outer anchor sleeve 30 to be slipped over the ends of the reinforcing members until internal cavity 34 of the anchor member is positioned over the end portions of the reinforcing members. The end wall of cavity 34 adjacent the bent sections of the members is inclined at about 45° to provide shoulder 38 that engages the bent sections.

To hold the ends of the reinforcing members in the cavity, portion 42*a* of inner anchor sleeve 42 is positioned inside the sheath opposite the cavity. The diameter of the cavity in outside anchor 30 and the outside diameter of portion 42*a* of sleeve 42 preferably are such that they will tightly engage the inside and outside surfaces of the reinforcing members.

The end of portion 42*a* of the inner anchor sleeve has beveled shoulder 46 at approximately the same angle as the bent sections of the reinforcing members to trap the bent sections between shoulder 38 and 46.

To move these shoulders together and into snug engagement with the bent portions of the reinforcing members, outside anchor sleeve 30 is internally threaded on its upper end. Threaded split ring 48 is used to force the outside anchor sleeve upwardly, as viewed in FIG. 3, and the inside anchor sleeve downwardly to force shoulders 38 and 46 respectively into firm engagement with the bent sections of the reinforcing members. At this time, as the sleeves start exerting force on the bent sections, the reinforcing members will move so that the clamping force exerted by the anchor sleeves will be substantially equally distributed among the individual reinforcing members. As a result, they will self-align themselves to have substantially the same overlap throughout the sheath. This occurs, as can be seen in FIG. 6, because as shoulder 38, which is indicated by a dotted line moves into engagement with the reinforcing members, they will be forced to adjust their position until the shoulder engages each member at the same point, which, in the example shown in FIG. 6, is the right hand edge of the members indicated by the letter E. The reinforcing members appear flat in FIGS. 5 and 6, but, preferably they are slightly curved in cross section, as shown in FIGS. 3 and 4.

The assembly of the upper packer head is completed by tapered pipe plug 49 that is made up in threads located in the split in ring 48 to expand the ring and force it into firm engagement with the internal threads on the outer anchor sleeve. Threaded sub 60 is connected to the outer anchor sleeve to support the packer through the internal threads provided on the anchor sleeve. Threaded sub 60 also provides the threads for connecting mandrel 12 into the pipe string and supporting it.

To complete the assembly of the packer after the packer head is clamped to the other end of the sheath of reinforcing members, inner sleeve 16 is positioned inside of the sheath of reinforcing members and anchored at each end in internal grooves 50 and 52 on the inside of inner anchor members 42 and 44 of the upper and lower packer heads. The sleeve is held in these grooves by expanded metal rings 54 and 56. Outer sleeve 18 is molded in place on the outside of the packer at which time it is bonded at each end to outer anchor sleeves 30 and 32 and to the reinforcing members.

Preferably, bends 21 and 23 should be in the opposite direction so that any turning moment caused by the force exerted by shoulder 38 at points E will be opposite to the turning moment imposed at points F by shoulder 40 of the lower head.

When the packer is inflated there is often a substantial pressure differential between the inside and outside of the packer. This pressure differential tends to force the elastomeric material of the inner sleeve into the openings that may exist between adjacent reinforcing members. The members will not move to a position where they do not continue to overlap, but they will, of course, move to where they are not overlapping as much and there can be cracks and openings between the members into which the elastomeric material of the inner sleeve can be extruded. When this occurs, it damages the inner sleeve and can reduce its useful life rapidly.

It is another feature of this invention to attach to the inner edge of each reinforcing member as shown in FIG. 7, strips 66*a*, 66*b*, and 66*c* of elastomeric material that are attached to overlapping reinforcing members 68*a*, 68*b*, and 68*c*. When the packer is inflated, inner sleeve 70 will engage the reinforcing members and also the elastomeric strips and force them into firm sealing engagement with the adjacent reinforcing member and keep the inner sleeve from being extruded into the space between the reinforcing members.

From the foregoing it will be seen that this invention is one well adapted to attain all of the ends and objects hereinabove set forth, together with other advantages that are obvious and that are inherent to the apparatus and structure.

It will be understood that certain features and subcombinations are of utility and may be employed without reference to other features and subcombinations. This is contemplated by and is within the scope of the claims.

Because many possible embodiments may be made of the invention without departing from the scope thereof, it is to be understood that all matter herein set forth or shown in the accompanying drawings is to be interpreted as illustrative and not in a limiting sense.

What is claimed is:

1. An inflatable packer comprising spaced packer heads, an inner sleeve of elastomeric material extending between the packer heads and attached thereto, a plurality of overlapping reinforcing members extending longitudinally from each packer head, each reinforcing member having an offset section that is bent out of the plane of the member to form a dihedral angle with the member along a line of intersection that makes an acute angle with the sides of the member, and means on the packer heads to engage the offset sections of the reinforcing members to hold the members from longitudinal movement relative to the packer heads.

2. The inflatable packer of claim 1 in which the reinforcing members are curved in cross section.

3. The inflatable packer of claim 1 in which the dihedral angles that the offset sections make with the reinforcing members are obtuse.

4. The inflatable packer of claims 1, 2, or 3 in which each reinforcing member has a strip of elastomeric material attached to the member and positioned to be forced into sealing engagement with the adjacent overlapping member to keep the inner sleeve of elastomeric material from being forced between the members by the inflating pressure.

5. The inflatable packer of claim 1 in which the holding means of each packer head includes an inner annular anchor member to which the inner sleeve of elastomeric material is attached and which extends into the opening formed by the overlapping reinforcing members to hold the bent sections of the reinforcing members from moving inwardly and an outer anchor member extending over the sheath of reinforcing members to engage the bent sections of the reinforcing members, and means to hold the outer and inner anchor members in such engagement with the reinforcing members.

6. The inflatable packer of claim 5 in which the inner and outer anchor members form a snug fit with the bent sections of the reinforcing members.

7. An inflatable packer comprising spaced annular packer heads, a sheath of reinforcing members extending longitudinally of the packer from each packer head, each reinforcing member comprising a strip of resilient material having a portion of the strip adjacent the end offset from the plane of the strip, said offset portion being connected to the rest of the strip by a connecting section that forms a dihedral angle with the strip and the offset portion along lines of intersection that intersect the sides of the strip at an acute angle to allow the strip to overlap another with their ends in alignment, each packer head having a shoulder facing toward the ends of the reinforcing members to engage the connecting section of each reinforcing member and hold the reinforcing members from longitudinal movement relative to the packer heads.

8. An inflatable packer comprising a tubular mandrel, spaced packer heads mounted on the mandrel for relative movement toward and away from each other; an inner sleeve of elastomeric material positioned on the outside of the mandrel between and attached to the packer heads, a plurality of reinforcing members extending longitudinally from each packer head over the inner sleeve, each reinforcing member having a portion that is bent out of the plane of the member adjacent each packer head to form a dihedral angle between the portion and the member along a line of intersection that extends across the member and intersects the sides of the reinforcing member at an acute angle to allow the reinforcing members to overlap with their ends in alignment to form a sheath, said packer heads including means to engage the bent out portions of the members to hold them from moving axially relative to the packer heads, and an outer sleeve of elastomeric material surrounding the reinforcing members.

9. The inflatable packer of claim 8 in which the reinforcing members are curved in cross section.

10. The inflatable packer of claim 8 in which the dihedral angles that the bent out portions make with the reinforcing members are obtuse.

11. The inflatable packer of claims 8, 9, or 10 in which each reinforcing member has a strip of elastomeric material attached to the member and positioned to be forced into sealing engagement with the adjacent overlapping member to keep the inner sleeve of elastomeric material from being forced between the members due to the inflating pressure.

12. The inflatable packer of claim 8 in which the holding means of each packer head includes an inner annular anchor member to which the inner sleeve of elastomeric material is attached and which extends into the opening formed by the overlapping reinforcing members to hold the end portions of the reinforcing members from moving inwardly and an outer anchor member extending over the sheath of reinforcing members to engage the bent out portions of the reinforcing members and means to hold the outer and inner anchor members in such engagement with the reinforcing members.

13. A reinforcing member for an inflatable packer comprising an elongated, relatively thin, member of resilient material and a strip of elastomeric material bonded to the longitudinal edge of the member to engage the adjacent overlapping member and seal the opening between the members.

14. A reinforcing member for an inflatable packer comprising an elongated, relatively thin, member of resilient material with an offset portion adjacent each end lying in a plane parallel to but spaced from the plane of the member and connected to the rest of the member by a connecting section that make dihedral angles with the member and the offset portion along lines that intersect the sides of the member and the offset portion at an acute angle to allow a plurality of members to be positioned in overlapping relationship with their ends in alignment to form an annular sheath and to be held against relative longitudinal movement by an annular shoulder positioned to clamp the connecting sections between them.

15. A reinforcing member for connecting to the packer head of a packer to support the packing element of the packer against differential pressure across the packer when the packer is set comprising an elongated, relatively thin, narrow, resilient member having an end portion that is offset to form a dihedral angle with the member along an oblique line of intersection that extends across the member to allow the member to be positioned in overlapping relationship with a plurality of members to form an annular sheath for supporting the packing element.

16. The reinforcing member of claim 15 in which the reinforcing member is curved in cross section.

17. An inflatable packer comprising spaced annular packer heads, a reinforcing sheath attached to each packer head, said sheath including a plurality of overlapping strips of resilient material with generally parallel sides, each strip having an offset section that is connected to the rest of the strip by a connecting section that forms dihedral angles with the strip and the offset section along oblique lines of intersection to allow the strips to overlap with their ends in alignment and means for engaging the connecting sections to hold the reinforcing members from longitudinal movement relative to the packer heads.

* * * * *